US009628903B2

(12) United States Patent
Munro et al.

(10) Patent No.: US 9,628,903 B2
(45) Date of Patent: Apr. 18, 2017

(54) MICROSPEAKER ACOUSTICAL RESISTANCE ASSEMBLY

(71) Applicant: Bose Corporation, Framingham, MA (US)

(72) Inventors: Andrew D. Munro, Arlington, MA (US); Christopher A. Pare, Franklin, MA (US); Lei Cheng, Wellesly, MA (US); Nicholas John Joseph, Boston, MA (US); Benjamin G. K. Peterson, West Boylston, MA (US)

(73) Assignee: Bose Corporation, Framingham, MA (US)

( * ) Notice: Subject to any disclaimer, the term of this patent is extended or adjusted under 35 U.S.C. 154(b) by 38 days.

(21) Appl. No.: 14/580,528

(22) Filed: Dec. 23, 2014

(65) Prior Publication Data

US 2016/0182992 A1 Jun. 23, 2016

(51) Int. Cl.

| | |
|---|---|
| ***H04R 1/28*** | (2006.01) |
| ***H04R 9/02*** | (2006.01) |
| ***H04R 9/06*** | (2006.01) |
| *H04R 1/10* | (2006.01) |
| *H04R 3/04* | (2006.01) |

(52) U.S. Cl.

CPC ..... *H04R 1/2846* (2013.01); *H04R 1/2811* (2013.01); *H04R 1/2826* (2013.01); *H04R 9/025* (2013.01); *H04R 9/06* (2013.01); *H04R 1/1016* (2013.01); *H04R 3/04* (2013.01); *H04R 2400/11* (2013.01)

(58) Field of Classification Search

CPC ..... H04R 1/023; H04R 1/1016; H04R 1/1058–1/1075; H04R 1/28; H04R 1/2803–1/2823; H04R 1/2838–1/2849; H04R 1/2869–1/2896; H04R 9/02; H04R 9/025; H04R 2400/07; H04R 2400/11

See application file for complete search history.

(56) References Cited

U.S. PATENT DOCUMENTS

| | | | |
|---|---|---|---|
| 4,086,445 | A | 4/1978 | Robinson |
| 4,745,887 | A | 5/1988 | Ito et al. |

(Continued)

FOREIGN PATENT DOCUMENTS

| | | |
|---|---|---|
| CN | 203378017 | 1/2014 |
| EP | 0909077 A2 | 4/1999 |

(Continued)

OTHER PUBLICATIONS

International Search Report & Written Opinion in counterpart International Patent Application No. PCT/US15/067284, mailed on Apr. 13, 2016; 11 pages.

*Primary Examiner* — Curtis Kuntz
*Assistant Examiner* — Joshua Kaufman
(74) *Attorney, Agent, or Firm* — Schmeiser, Olsen & Watts LLP

(57) ABSTRACT

An electro-acoustic transducer is provided that comprises a diaphragm and a magnet assembly comprising a magnet and a back plate. The back plate comprises at least one first vent. The diaphragm generates sound during a movement of the diaphragm relative to the back plate. The transducer further comprises a printed circuit board comprising at least one second vent and a cavity between the printed circuit board and the back plate that separates the at least one first vent from the at least one second vent.

20 Claims, 16 Drawing Sheets

(56) References Cited

U.S. PATENT DOCUMENTS

| | | | | |
|---|---|---|---|---|
| 8,699,744 | B2 | 4/2014 | Sakaguchi et al. | |
| 8,731,223 | B2 | 5/2014 | Seo | |
| 9,414,145 | B2 * | 8/2016 | Oishi | H04R 1/10 |
| 2008/0219482 | A1 | 9/2008 | Sato | |
| 2010/0331058 | A1 * | 12/2010 | Qingshan | H04M 1/035<br>455/575.1 |
| 2013/0148834 | A1 * | 6/2013 | Seo | H04R 1/2811<br>381/338 |
| 2014/0056455 | A1 | 2/2014 | Sakaguchi et al. | |

FOREIGN PATENT DOCUMENTS

| | | | |
|---|---|---|---|
| EP | 1799011 | A1 | 6/2007 |
| JP | S60218998 | | 11/1985 |
| JP | H587543 | | 4/1993 |
| JP | H5199575 | | 8/1993 |
| JP | H8228392 | | 9/1996 |
| JP | 200971571 | | 4/2009 |
| JP | 5069620 | | 11/2012 |
| WO | 2014059638 | | 4/2014 |

* cited by examiner

MICROSPEAKER ACOUSTICAL RESISTANCE ASSEMBLY

BACKGROUND

This description relates generally to audio transducers, and more specifically, to an acoustical resistance assembly of a transducer used in an in-ear headphone.

BRIEF SUMMARY

In accordance with one aspect, an electro-acoustic transducer is provided that comprises a diaphragm and a magnet assembly comprising a magnet and a back plate. The back plate comprises at least one first vent. The diaphragm generates sound during a movement of the diaphragm relative to the back plate. The transducer further comprises a printed circuit board comprising at least one second vent and a cavity between the printed circuit board and the back plate that separates the at least one first vent from the at least one second vent.

Examples may include one or more of the following:

A first geometry of the at least one second vent relative to the at least one first vent may provide a first frequency response for the transducer. A second geometry of the at least one second vent relative to the at least one first vent may provide a second frequency response different from the first frequency response for the transducer.

The at least one first vent may include a hole that is offset from an outer diameter of the back plate.

The at least one first vent may be located at an outer diameter of the back plate.

The at least one second vent may comprise micro apertures extending through the printed circuit board, or PCB.

The at least one second vent may range in diameter from 50 μm to 200 μm.

The at least one second vent may comprise a plurality of air holes extending through the printed circuit board and a scrim material coupled to the printed circuit board and positioned over the air holes.

The at least one first vent and the at least one second vent may be constructed and arranged to provide an acoustical resistance of air flowing between an external environment and an interior of the transducer, and for shaping a frequency response for the electro-acoustic transducer.

The at least one first vent of the back plate and the at least one second vent of the printed circuit board may each have a total acoustical impedance that includes a real part and an imaginary part. The real part of the total acoustical impedance of the at least one first vent may be lower than the real part of the total acoustical impedance of the at least one second vent.

In accordance with another aspect, an electro-acoustic transducer is provided that comprises a diaphragm and a magnet assembly comprising a magnet and a back plate. The back plate comprises at least one first vent hole. The diaphragm generates sound during a movement of the diaphragm relative to the back plate. A printed circuit board comprises at least one second vent hole. A cavity between the printed circuit board and the back plate separates the at least one first vent hole from the at least one second vent hole in the printed circuit board. A scrim material is coupled to a surface of the printed circuit board in the cavity, and is positioned over the at least one air hole.

Examples may include one or more of the following:

A first geometry of the at least one first vent hole may provide a first frequency response for the transducer. A second geometry of the at least one vent hole may provide a second frequency response different from the first frequency response for the transducer.

The at least one first vent hole may be offset from an outer diameter of the back plate.

The at least one first vent hole may be located at an outer diameter of the back plate.

The at least one first vent hole and the at least one second vent hole may be constructed and arranged to provide an acoustical resistance of air flowing between an external environment and an interior of the transducer, and for shaping a frequency response for the electro-acoustic transducer.

The at least one first vent hole of the back plate and the at least one second air hole of the printed circuit board may each include a plurality of vent holes having a total acoustical impedance that includes a real part and an imaginary part. The real part of the total acoustical impedance of the back plate vent holes may be lower than the real part of the total acoustical impedance of the printed circuit board vent holes.

In accordance with another aspect, an acoustic device is provided comprising a diaphragm and a magnet assembly comprising a magnet and a back plate. The back plate comprises at least one vent hole. The diaphragm generates sound during a movement of the diaphragm relative to the back plate. A printed circuit board comprises at least one micro vent. A cavity between the printed circuit board and the back plate separates the at least one vent hole from the at least one micro vent of the printed circuit board.

Examples may include one or more of the following:

A first geometry of the at least one micro vent relative to the at least one vent hole may provide a first frequency response for the transducer. A second geometry of the at least one micro vent relative to the at least one vent hole may provide a second frequency response different from the first frequency response for the transducer.

The at least one vent hole and the at least one micro vent may each have a total acoustical impedance that includes a real part and an imaginary part, and wherein the real part of the total acoustical impedance of the at least one back plate vent hole may be lower than a real part of a total acoustical impedance of the at least one micro vent.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Modern in-ear headphones, or earbuds, typically include a microspeaker comprising a permanent magnet and a voice coil that is attached to a diaphragm that pushes the air around it, which in turn creates a sound that is output to a user. In doing so, the microspeaker must produce a sufficient sound pressure over the entire frequency range over which the device will be used.

Figure 1:
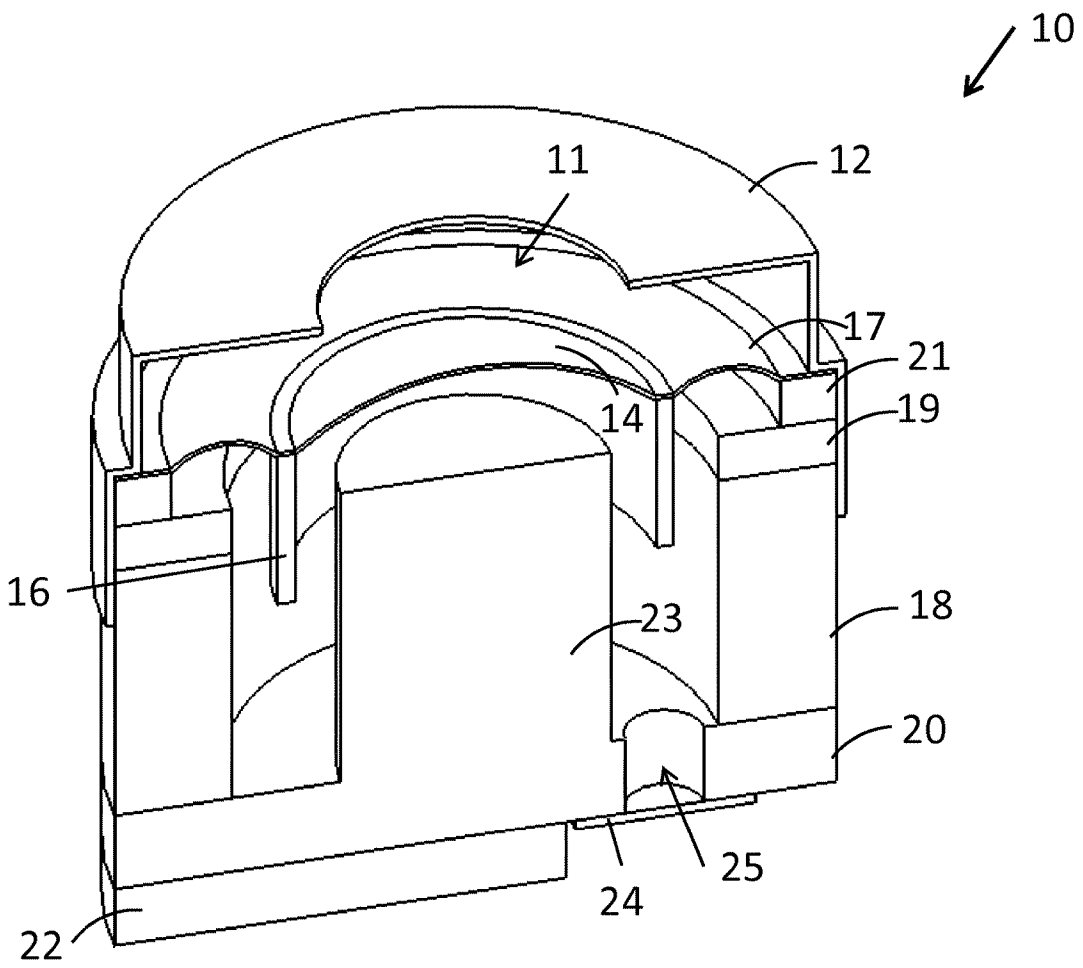
FIG. 1 is an isometric view of a cross-section of a microspeaker with an example of a conventional acoustical resistance assembly.
Figure 2:
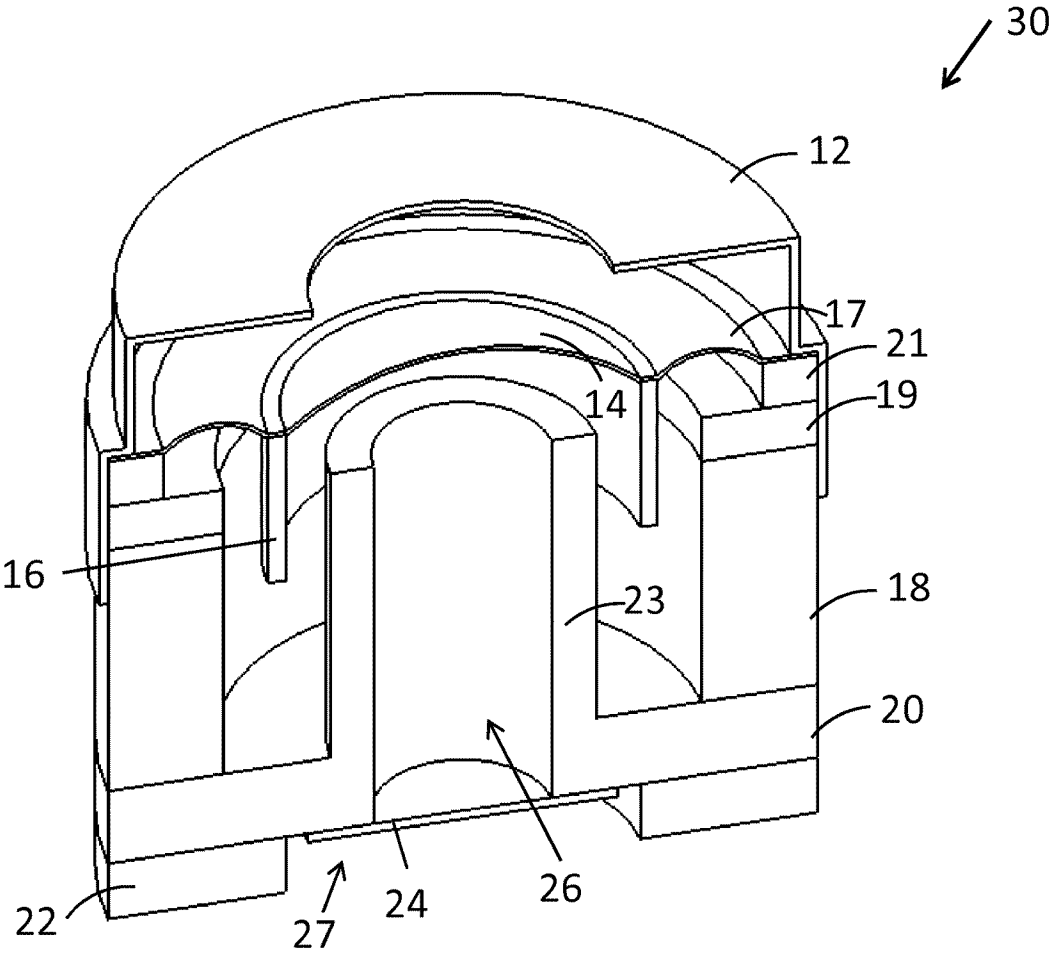
FIG. 2 is an isometric view of a cross-section of a microspeaker with another example of a conventional acoustical resistance assembly.

According to FIGS. 1 and 2, each acoustical resistance assembly 10, 30 may include a protective cover 12, a diaphragm 14, a voice coil 16, a permanent magnet 18, a suspension element 17, a front plate 19, a back plate 20, and a printed circuit board (PCB) 22. The protective cover 12 protects the diaphragm 14 from damage during operation and includes an opening 11 for outputting the sound generated at the diaphragm 14 to an ear canal or the like.

The diaphragm 14 is coupled to, and driven by, the voice coil 16. More specifically, as is well-known, the voice coil 16 is positioned in a permanent magnetic field generated by the magnet 18 and will move when an electrical current is applied to the voice coil 16. The diaphragm 14 can be circular or non-circular in shape, and is coupled to a diaphragm ring 21 or other supporting member via the suspension element 17, sometimes referred to as a surround. The surround 17 and diaphragm 14 may be constructed as a single component or as separate components. In operation, the surround 17 allows the diaphragm 14 to move in a reciprocating manner in response to an electrical current applied to the voice coil 16. Movement of the diaphragm causes changes in air pressure, which results in a production of sound.

The magnet 18 is sandwiched between the front plate 19 and the back plate 20. The back plate 20 in turn is coupled to the PCB 22. The back plate 20 can have a pole piece 23 that extends from a base portion of the back plate 20 towards the diaphragm 14. The voice coil 16 is positioned about the pole piece 23.

The assembly 10 shown in FIG. 1 includes a single vent hole 25 that extends through the back plate 20. When the diaphragm 14 moves, air is forced through the back plate vent hole 25. The assembly 30 shown in FIG. 2 includes a single vent hole 26 that extends through the center of the pole piece 23. As with the assembly 10 shown in FIG. 1, when the diaphragm 14 moves, air is forced through the pole piece vent hole 26. The vent holes 25, 26 can be applied to achieve a range of frequency response shapes, due to the vent holes 25, 26 contributing to the acoustical impedance of the respective assemblies 10, 30.

A covering, or scrim 24, can be positioned over the back plate vent hole 25 and/or pole piece vent hole 26 to provide an acoustical resistance at the respective vent hole 25, 26. In the example of FIG. 1, the PCB 22 is cut short to create space for positioning the scrim material 24 over the vent hole 25. In the example of FIG. 2, the PCB 22 includes an opening 27 to create space for positioning the scrim material 24 over the vent hole 26. The scrim 24 can be formed of acoustically resistive materials such as a non-woven fabric, woven fabric, wire mesh, or the like. Changes in the acoustical resistance of the air flowing through the scrim 24 may further affect the frequency response of the driver in an earbud or related in-ear headset, the fundamental resonance of the driver, and may also have an impact on the damping of other acoustical resonances in the assembly 10, 30.

Figure 3:
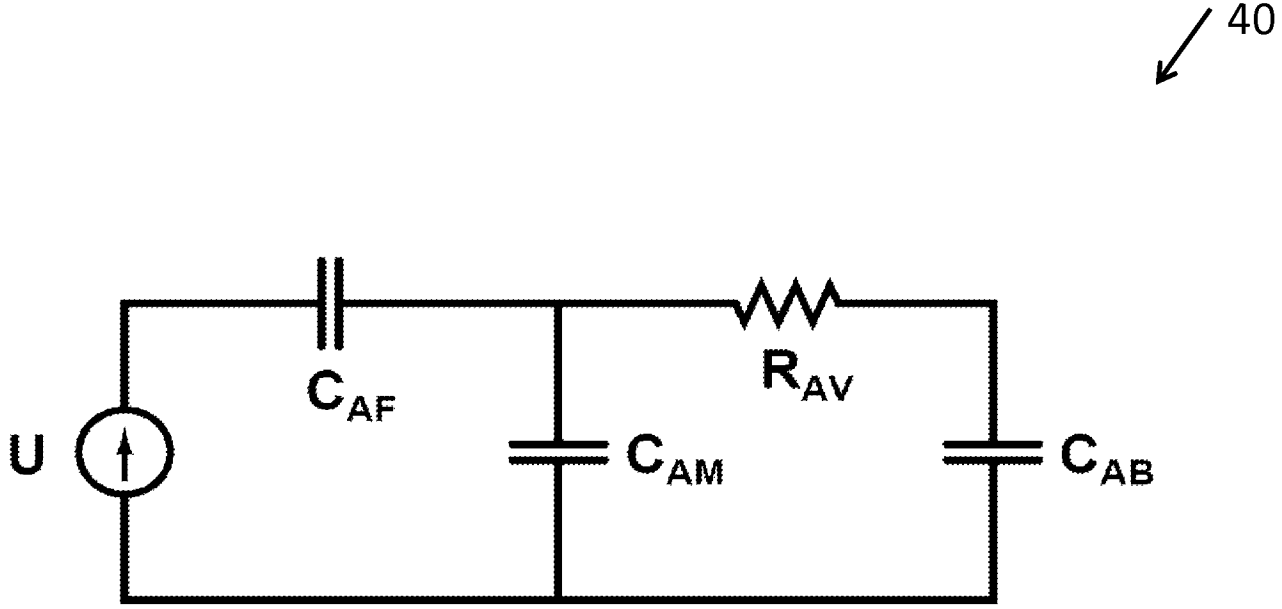
FIG. 3 is an equivalent circuit diagram for acoustical components of a conventional microspeaker positioned in an earbud.

FIG. 3 is a view of an equivalent circuit diagram 40 for acoustical components of a conventional microspeaker for example, including acoustical resistance assembly 10 or 30 described herein. The microspeaker may be inserted in an earbud or related in-ear headset having a sealed back. The various features of the assembly 10 of FIG. 1 and the assembly 30 of FIG. 2 are represented by the acoustical impedance circuit 40.

Figure 4:
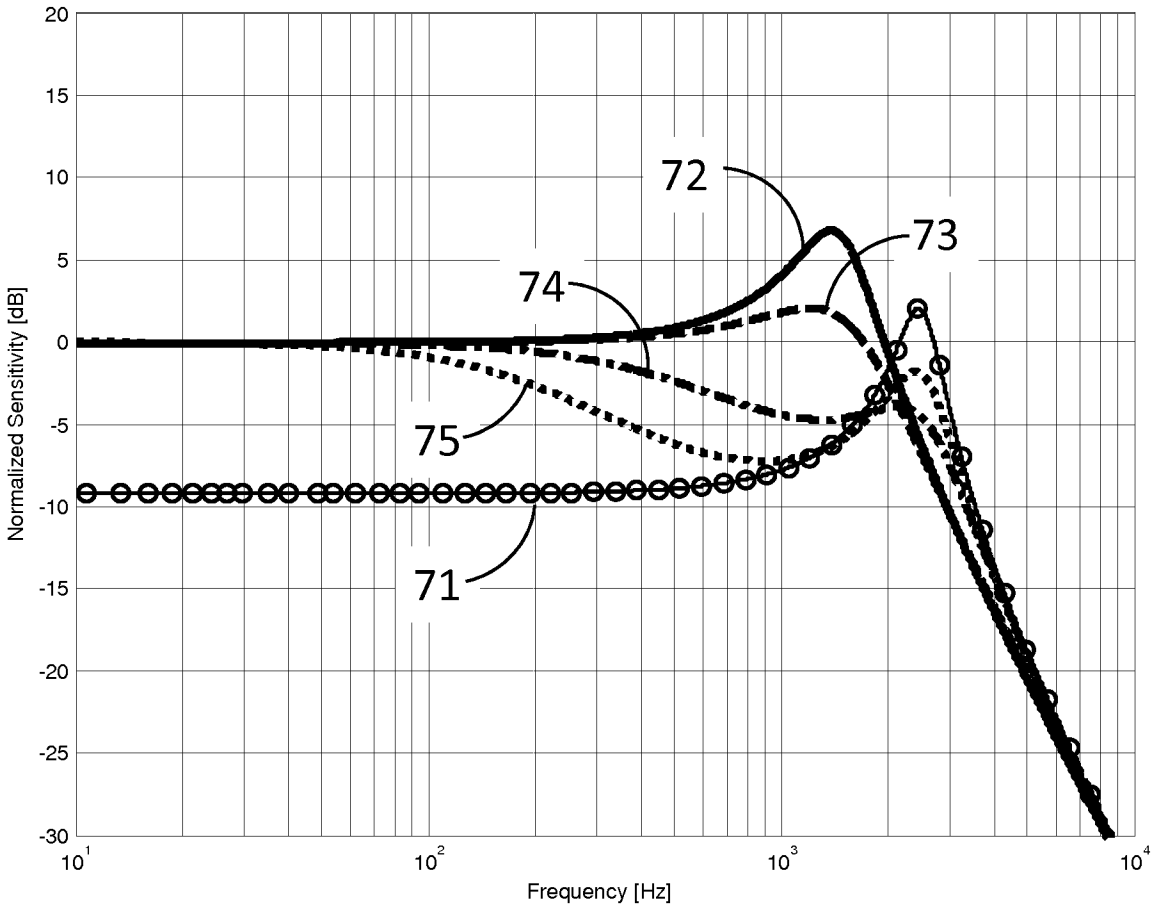
FIG. 4 is a graph illustrating frequency response curves corresponding to a conventional microspeaker positioned in an earbud.

An air region between the top surface of the diaphragm 14 and the ear canal (not shown) is represented by an acoustical compliance $C_{AF}$. The output is the pressure in the front cavity, i.e., at acoustical compliance $C_{AF}$. The motion of the diaphragm 14 is represented by the volume velocity source U. An air region under the diaphragm 14 in the motor cavity 29 is represented by an acoustical compliance $C_{AM}$. The active region of the scrim 24 over the vent hole 25, 26 is represented by an acoustical resistance $R_{AV}$. An air region at the back side of the transducer in a sealed earbud enclosure (not shown) is represented by an acoustical compliance $C_{AB}$. The acoustical system represented by the equivalent circuit 40 permits the frequency response of the assemblies 10, 30 to be derived mathematically. In particular, acoustical pressure can be plotted as a dependent variable and input excitation frequencies can be plotted independent variables. The curves 71-75 shown in FIG. 4 correspond to frequency response curves for an acoustical resistance assembly described herein, depending on selected design parameters which as described herein can affect the acoustical resistance $R_{AV}$ of the assembly 10 or 30. The acoustical resistance $R_{AV}$ in turn can have an impact on the sensitivity of the microspeaker. In FIG. 4, the horizontal axis represents a frequency range of 10 Hz to 10 KHz, and the vertical axis represents the normalized sound pressure level for varying values of $R_{AV}$.

In FIG. 4, frequency response curve 71 is generated from an acoustical resistance assembly 10, 30 where the vent hole 25, 26 is blocked, non-existent, or otherwise prevents air (sound) from passing through the vent hole 25, 26. Here, the acoustical resistance at the vent hole 25, 26 is large, e.g., $R_{AV} \approx \infty$. Frequency response curve 72, on the other hand, is generated from an acoustical resistance assembly 10, 30 where the vent hole 25, 26 is open so that air passes through the vent hole 25, 26 in an uninterrupted manner. Here, the acoustical resistance at the vent hole 25, 26 is negligible, e.g., $R_{AV} \approx 0$. Thus, frequency response curves 71 and 72 represent the two extreme cases of no venting and venting with negligible acoustical resistance, respectively. The remaining frequency response curves 73-75 illustrate intermediate examples, with varying levels of acoustical resistance. For example, curve 73 indicates that the scrim 24 over the vent hole 25, 26 is more porous, and permits more air to pass through the vent hole 25, 26 than the scrim 24 corresponding to curve 74. Similarly, curve 75 indicates that air is more difficult to pass through the vent hole 25, 26 due a less porous scrim 24 than the scrim corresponding to curve 74.

In order to modify the vents in the back plate 20 to tailor the frequency response, structural changes must be made to the PCB, and possibly the scrim 24, 22, to accommodate for the back plate vent hole modifications, for example, to align the openings in the PCB with the back plate vent holes. Scrim materials are typically available having a discrete set of flow resistances. However, the use of commercially available scrim to modify the characteristics of the microspeaker may require the area of the hole and active area of the scrim 24 to be changed. In configurations having a back plate and a PCB, both the back plate and the PCB may need to be changed to modify the frequency response of the microspeaker in the in-ear headset.

In brief overview, examples described herein provide a system and method for venting the motor of a microspeaker in a flexible manner, and with reduced design complexity, to achieve a wide range of frequency responses (e.g. those shown in FIG. 4). This is achieved by tailoring the frequency response of the microspeaker in an in-ear headset by modifying the PCB, while maintaining the back plate configuration, for example, without changing the geometry of the back plate vents. Accordingly, a transducer design may be modified for different applications to achieve a desired frequency response.

Figure 5A:
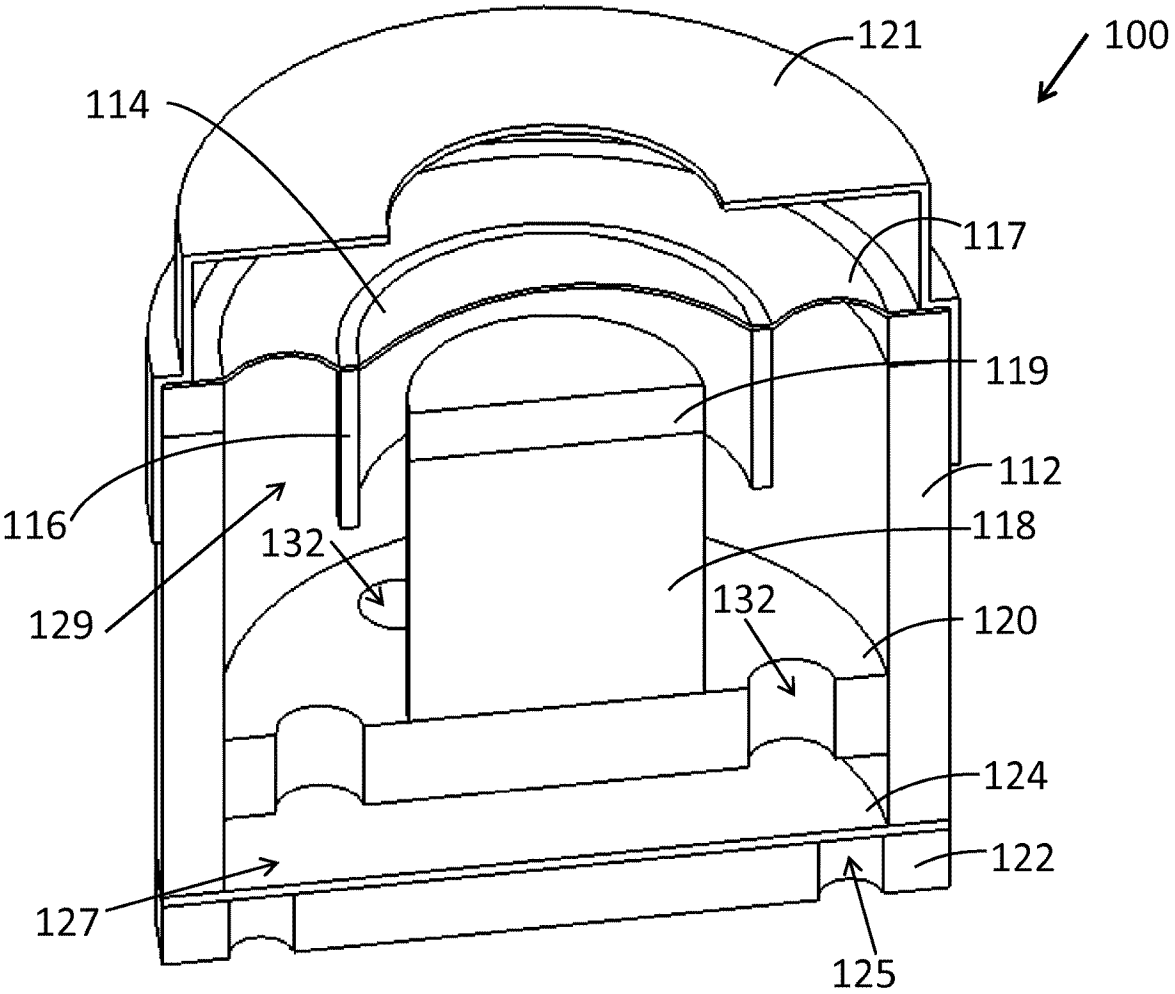
FIG. 5A is an isometric view of a cross-section of a microspeaker with an acoustical resistance assembly, in accordance with some examples.
Figure 5B:
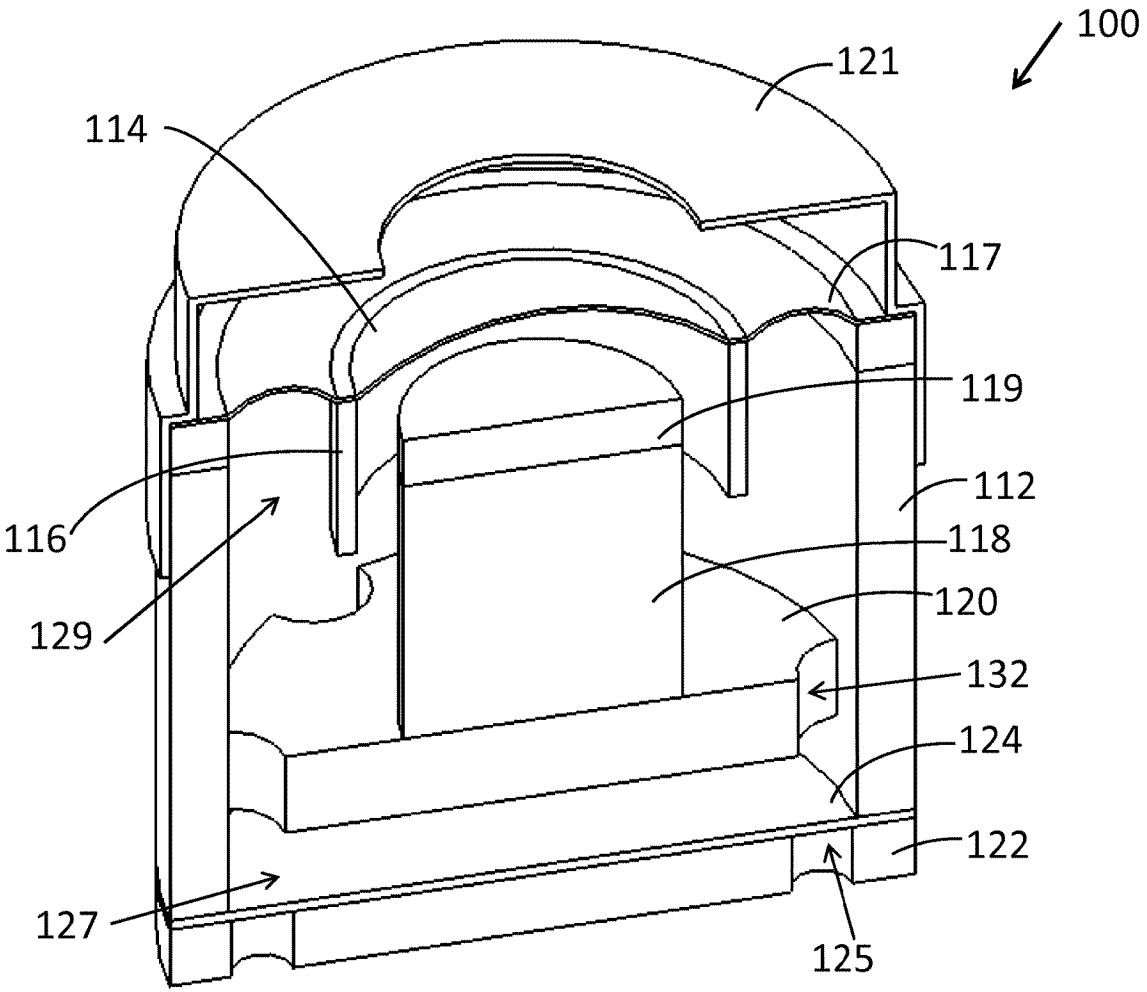
FIG. 5B is an isometric view of a cross-section of a microspeaker with an acoustical resistance assembly, in accordance with some examples.

Although a microspeaker is shown and described, inventive concepts described herein can equally apply to other small transducers. Referring to FIGS. 5A and 5B, the microspeaker 100 includes a housing or sleeve 112, a diaphragm 114, a coil 116, a surround 117, a permanent magnet 118, a coin 119 or front plate, a back plate 120, a printed circuit board (PCB) 122, and a scrim 124. The sleeve 112 has a hollow interior at which the front plate 119, back plate 120, magnet 118, and coil 116 are positioned. A protective cover 121 can be positioned about the top of the sleeve 112 to protect the diaphragm 114 from damage during operation.

One or more air holes 125 extend through the PCB 122. A scrim 124 is positioned on a surface of the PCB 122 facing the back plate 120, and covers the air holes 125. The scrim 124 can be attached to the PCB 122 by an adhesive or other coupling mechanism or bonding technique. The scrim 124 and PCB 122 are separated from the back plate 120 by a predetermined distance so that a cavity 127 is formed between the PCB 122 and the back plate 120. Scrim material may include, but not be limited to, woven monofilament fabric, wire cloth, nonwoven fabric, or related material to further tune the desired level of acoustical resistance, and thus the frequency response of the microspeaker. Accordingly, acoustical resistances of the scrim material can range from 3 to 260 Pa/(m/s), but not limited thereto. Pore sizes can range from 18 um to 285 um, but not limited thereto.

The air holes 125, either alone or in combination with the scrim 124 shown in FIGS. 5A and 5B, form vents (referred to as second vents) which provide a desired level of acoustical resistance for air traveling between an external environment and the cavity 127 through the scrim 124. The size, shape, location, number, and placement of the vent holes 125 in the PCB 122 can vary, as can the number of vent holes 125, depending on the desired frequency response for the microspeaker.

One or more vent holes 132 are located in the back plate 120. Although vent holes 132 are referred to herein, the term vent hole 132 can also refer to notches or the like that are formed at the periphery of the back plate 120. In the example of FIG. 5B, the vent holes 132 are located at the outer diameter of the back plate 120. Here, notches 132 are formed in the periphery, or outer diameter, of the back plate 120, where the notch 132 is defined by a portion of the back plate 120, and where a functional vent is formed when the back plate 120 is inserted into the sleeve 112. In the example of FIG. 5A, the vent holes 132 are located inboard from the outer diameter of the back plate 120. Here, the back plate vent holes 132 can be formed by drilling through-holes in the back plate 120 where the entirety of the hole 132 is surrounded by the back plate 120. The size, shape, location, number, and placement of the vent holes 132 in the back plate 120 can vary, as can the number of vent holes 132.

The back plate vent holes 132 are constructed and arranged to behave principally as an acoustical mass. More specifically, the vent holes 132 each has a cross-sectional area, diameter, or related dimension that is sufficiently large so that the complex acoustical impedance of the vent holes 132 is primarily imaginary or reactive. There will also be a real or resistive component to the complex acoustical impedance of the vent holes 132. The real part of the total acoustical impedance of all the back plate vent holes combined is significantly lower than the real part of the total acoustical impedance of all the PCB vents combined (including the effect of the scrim 124 if it is present).

Figure 9:
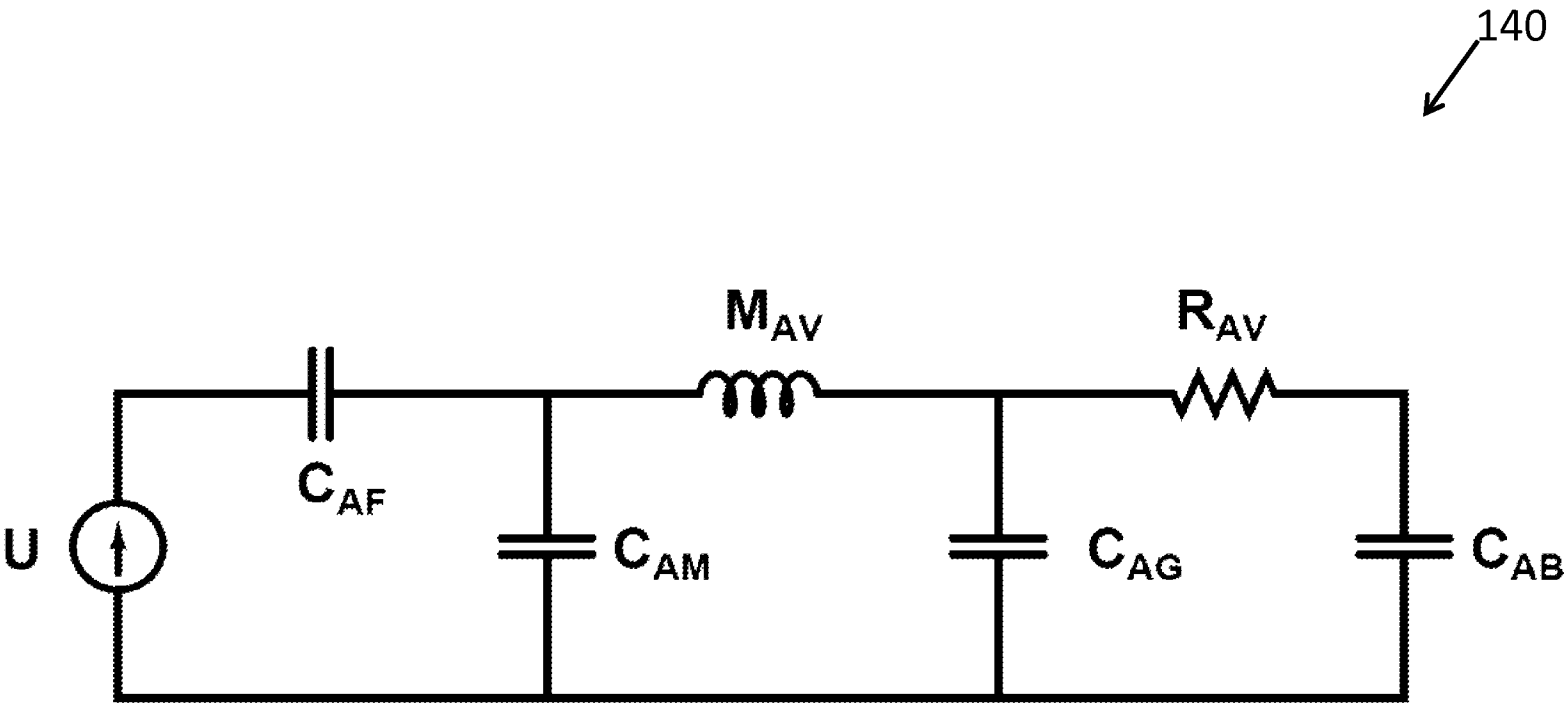
FIG. 9 is an equivalent circuit diagram for the acoustical components of a microspeaker of FIGS. 5A-8 positioned in an earbud, in accordance with some examples.

As shown in FIG. 9, an air region between the top surface of the diaphragm 114 and the ear drum (not shown) is represented by an acoustical compliance $C_{AF}$. The output is the pressure in the front cavity, i.e., at acoustical compliance $C_{AF}$. The motion of the diaphragm 114 is represented by the volume velocity source U. An air region under the diaphragm 114 in the motor cavity 29 is represented by an acoustical compliance $C_{AM}$. An air region at the back side of the transducer in a sealed earbud enclosure (not shown) is represented by an acoustical compliance $C_{AB}$.

In accordance with some examples, the scrim 124 covering the air holes 125 in the PCB 122 is represented by an acoustical resistance $R_{AV}$ (distinguished from $R_{AV}$ described with reference to a conventional assembly of FIGS. 3 and 4). In particular, each air hole 125 has an acoustical resistance. The acoustical resistances of all air holes 125 are combined into a single element ($R_{AV}$). Air regions in each back plate vent hole 132 are collectively represented by an equivalent mass $M_{AV}$. In particular, each vent hole 132 has an acoustical mass. The acoustical masses of all vent holes 132 are combined into a single element ($M_{AV}$). An air region in the cavity 127 is represented by an acoustical compliance $C_{AG}$.

Figure 10A:
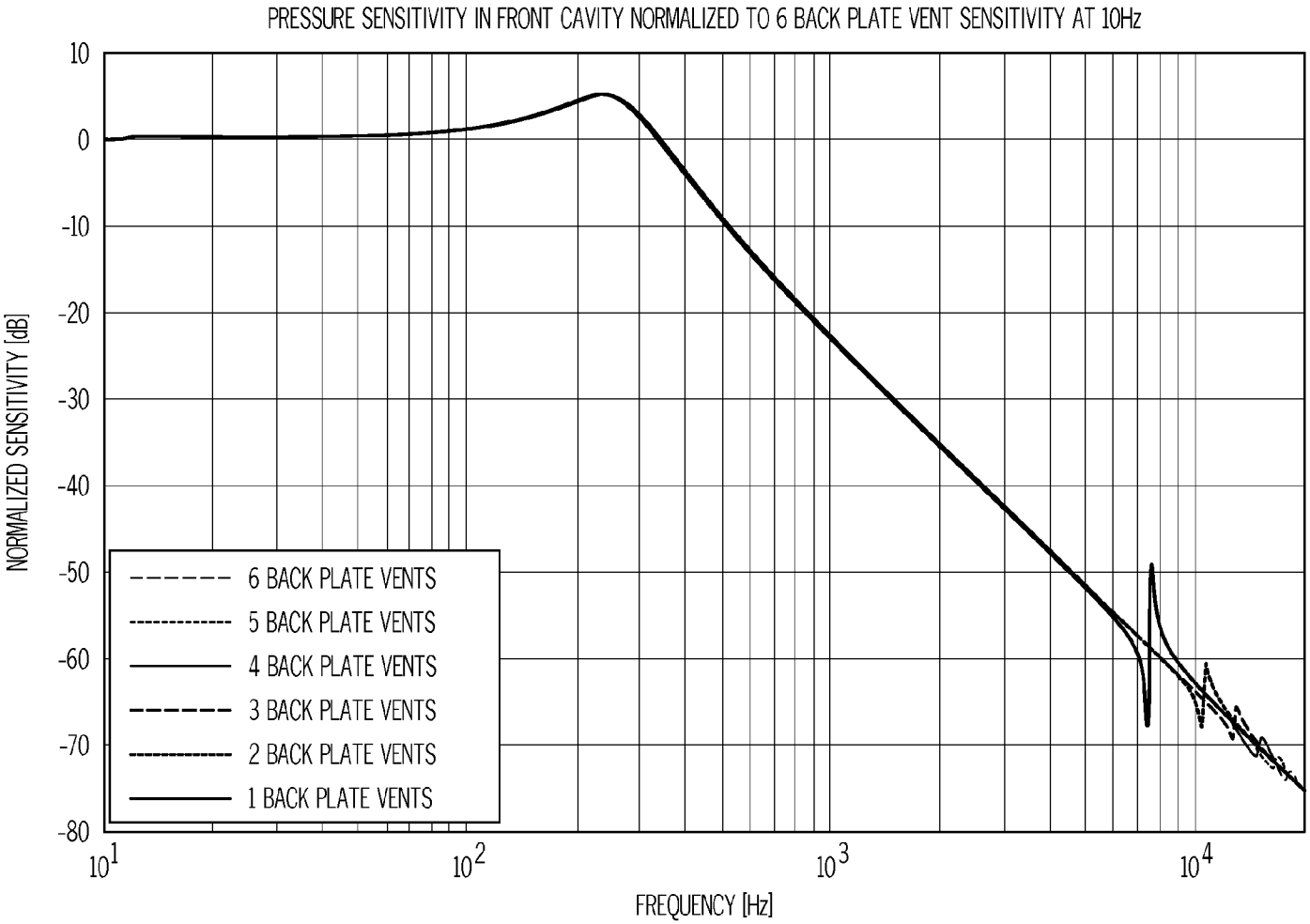
FIGS. 10A and 10B are frequency response graphs, in accordance with some examples.
Figure 10B:
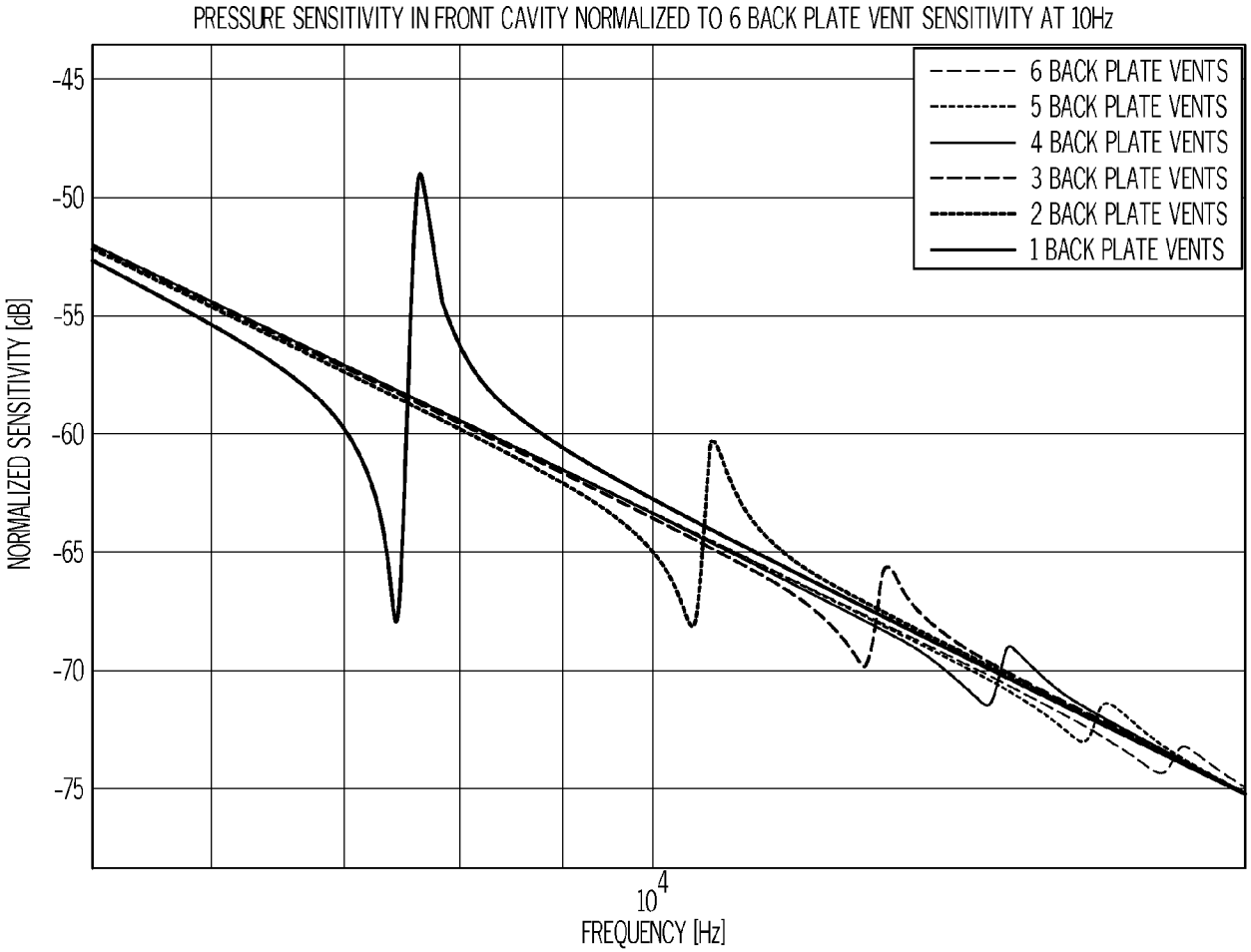

The presence of the back plate vent holes 132 provides additional flexibility with respect to impacting the frequency response of the transducer. As described above, each vent hole 132 acts primarily as an acoustical mass $M_{AV}$. An acoustical resonance of the system corresponds to the acoustical mass $M_{AV}$, along with the acoustical compliance of air $C_{AM}$. The acoustical impedances associated with the back plate vent holes 132, respectively, can be configured to be parallel to each other. The back plate vent holes 132 can be constructed and arranged to achieve this. In doing so, the total acoustical mass can be reduced, which moves the resonance higher in frequency. This resonance may be dampened due to the acoustical resistance of the PCB 22 (with or without the scrim 24), which may be problematic if the acoustical resistance is too low. FIGS. 10A and 10B illustrate the impact on pressure sensitivity at the front cavity of the assembly 100 by reducing the number of back plate vent holes 132, for example, from six vent holes to a single vent hole.

In some examples, the back plate vent holes 132 are each positioned on an axis that may extend in a direction of diaphragm motion. The PCB air holes 125 can be offset from the back plate vent holes 132, i.e., positioned on a different axis than the axis along which a neighboring back plate vent hole 132 is positioned. Alignment of the PCB air holes 125 and back plate vent holes 132 is not necessary because the pressure in the cavity 127 is assumed to be uniform at the frequencies of interest. Accordingly, PCB air holes 125 and back plate vent holes 132 can be misaligned with respect to each other, with no penalty with respect to performance. This provides flexibility in the mechanical design of these components so that they can be made easier to fabricate and assemble as compared to conventional approaches. Accordingly, to achieve, for example, to shape, a desired frequency response in a transducer design, only modifications to the PCB air hole geometry are required.

Figure 6A:
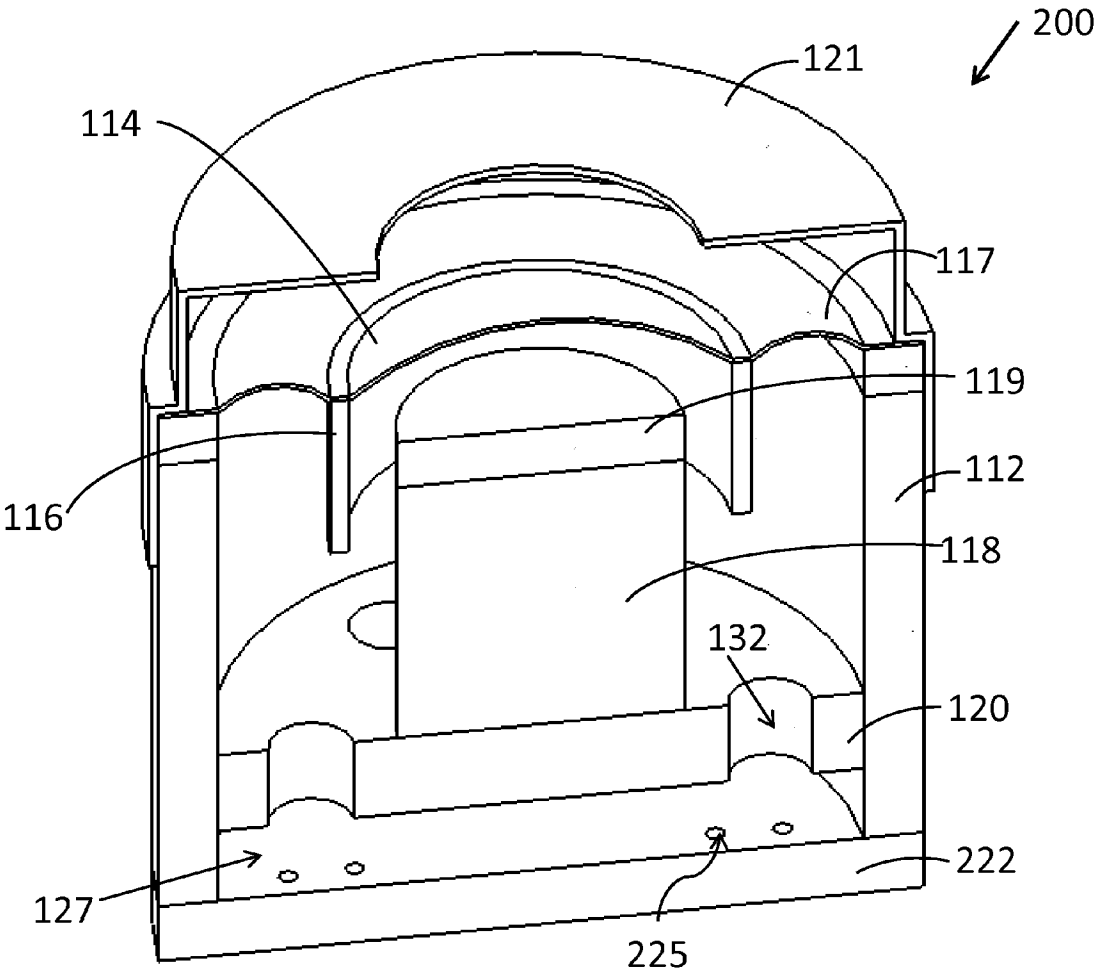
FIG. 6A is an isometric view of a cross-section of a microspeaker with an acoustical resistance assembly, in accordance with some examples.
Figure 6B:
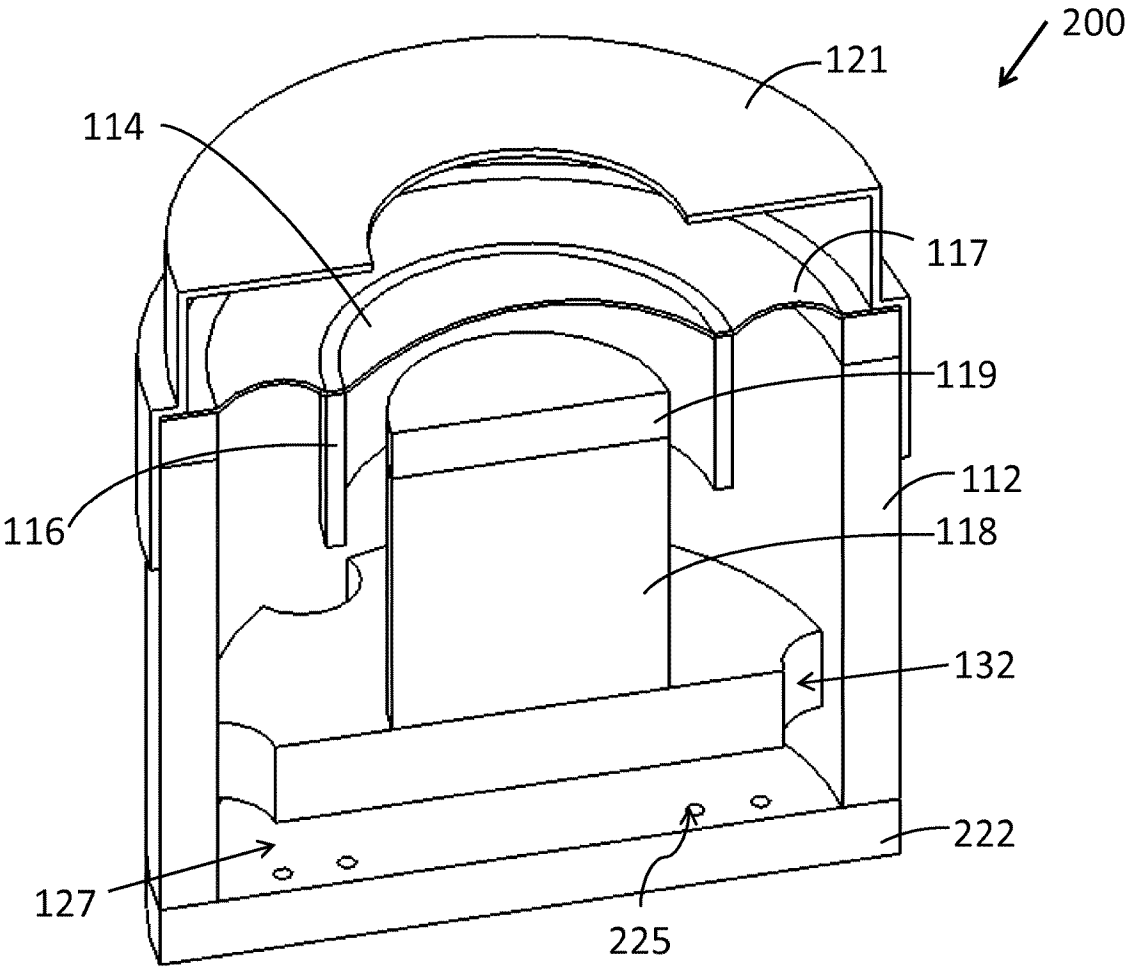
FIG. 6B is an isometric view of a cross-section of a microspeaker with an acoustical resistance assembly, in accordance with some examples.

Turning to FIGS. 6A and 6B, the acoustical resistance assembly 200 is similar to the assembly 100 of FIGS. 5A and 5B, except for the absence of a scrim material over the PCB 222. Instead, the scrim is replaced by a plurality of micro vents 225 or small apertures or holes extending through the PCB 222 to the cavity 127. The micro vents 225 serve as an "integral vent," obviating the need for a scrim or the like positioned over a PCB opening to achieve a desired acoustical resistance. The number and/or size of the micro vents 225 can establish the desired damping characteristics, and thus the frequency response, of the assembly 200. Similar to other examples in FIGS. 5A and 5B, the acoustical resistance of the assembly 200 can be adjusted by modifying the PCB 222 which in FIGS. 6A and 6B includes the addition of micro vents 225, but without the need to modify the back plate 120. In addition, the absence of a scrim simplifies the manufacturing process with respect to the assembly 200 due to a reduced part count along with a reduced number of adhesive joints otherwise required to bond the scrim to the PCB.

The acoustical resistance assembly 200 can be represented by the acoustical impedance circuit 140 illustrated at FIG. 9 which has been described above. Other equivalent circuits can equally apply. For example, an equivalent circuit can illustrate the back plate vents 132 and PCB micro vents 225 each as a generic acoustical impedance block with both real and imaginary components.

As described above, the back plate vent holes 132 can behave principally as an acoustical mass. On the other hand, the micro vents 225 are configured to have an area, length, and/or related dimensions to behave principally as an acoustical resistance. A relevant and important feature is for the real part of the total acoustical impedance of all the PCB vents combined (including the effect of scrim if it is present) to be significantly higher than the real part of the total acoustical impedance of all the back plate vent holes.

Figure 11:
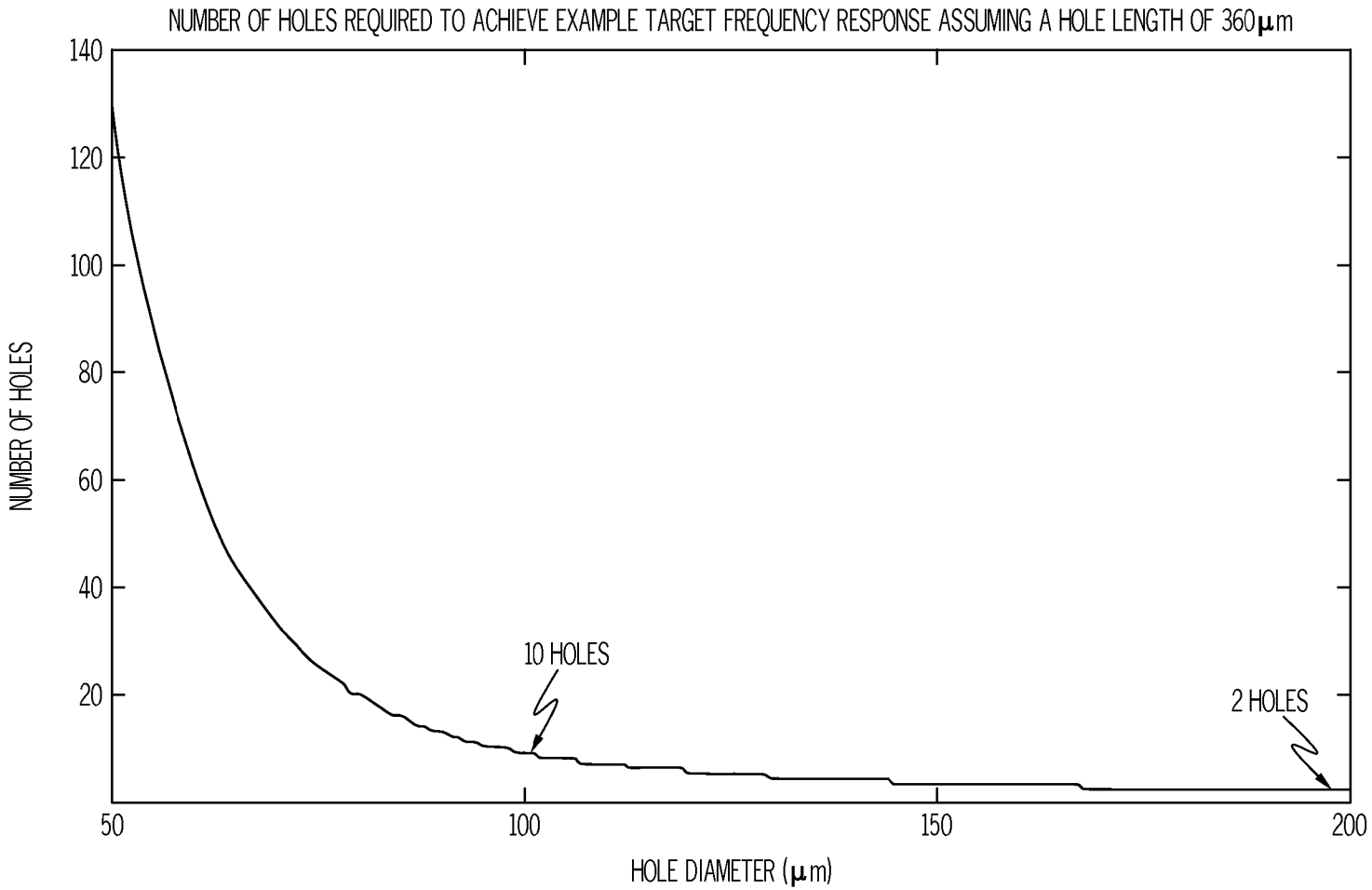
FIG. 11 is a graph illustrating a relationship between a number of PCB micro vents and hole diameter for a fixed total acoustical resistance of the array of micro vents, in accordance with some examples.
Figure 12A:
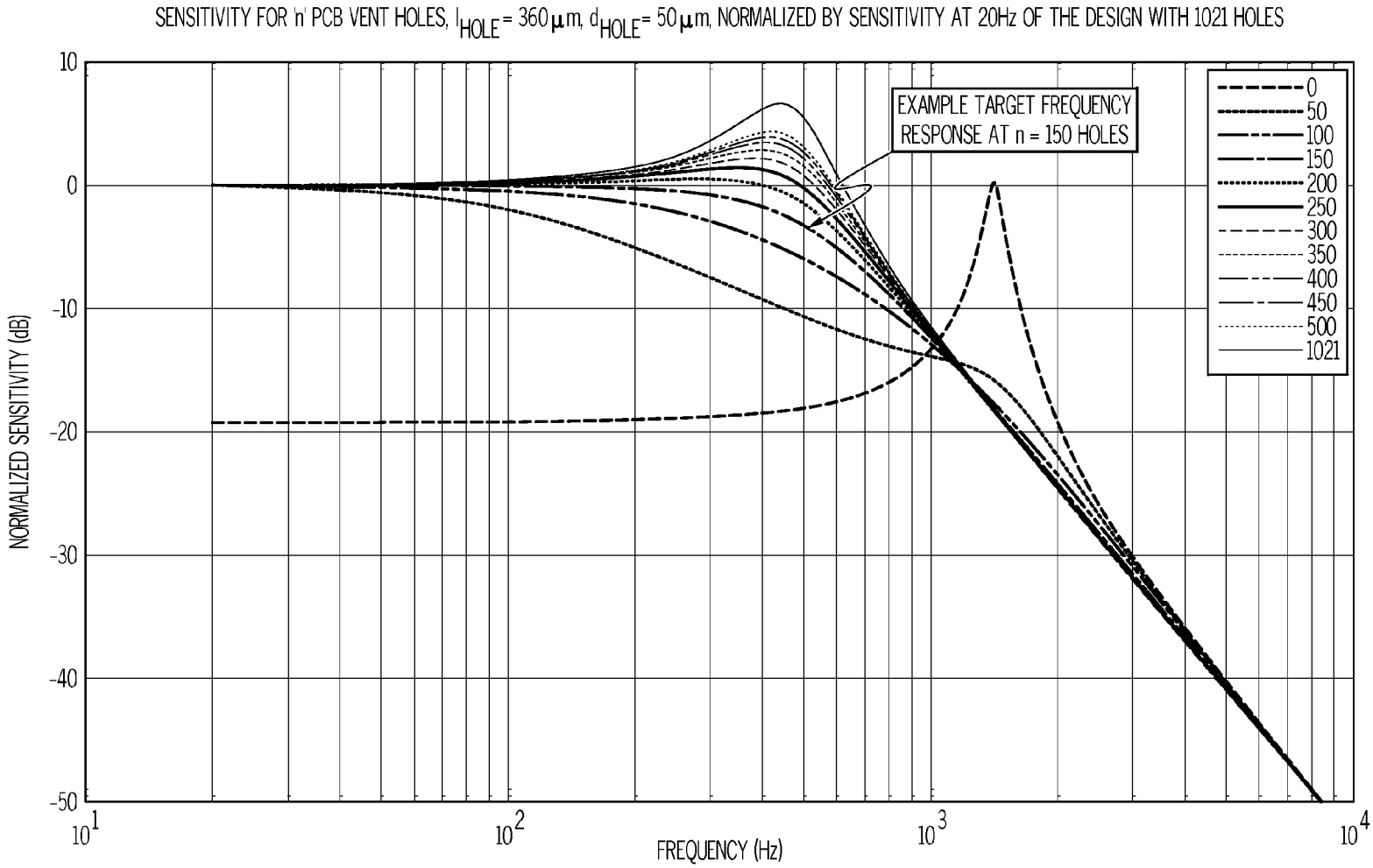
FIGS. 12A and 12B illustrate frequency responses corresponding to an acoustical resistance assembly configured with PCB micro vents, in accordance with some examples.
Figure 12B:
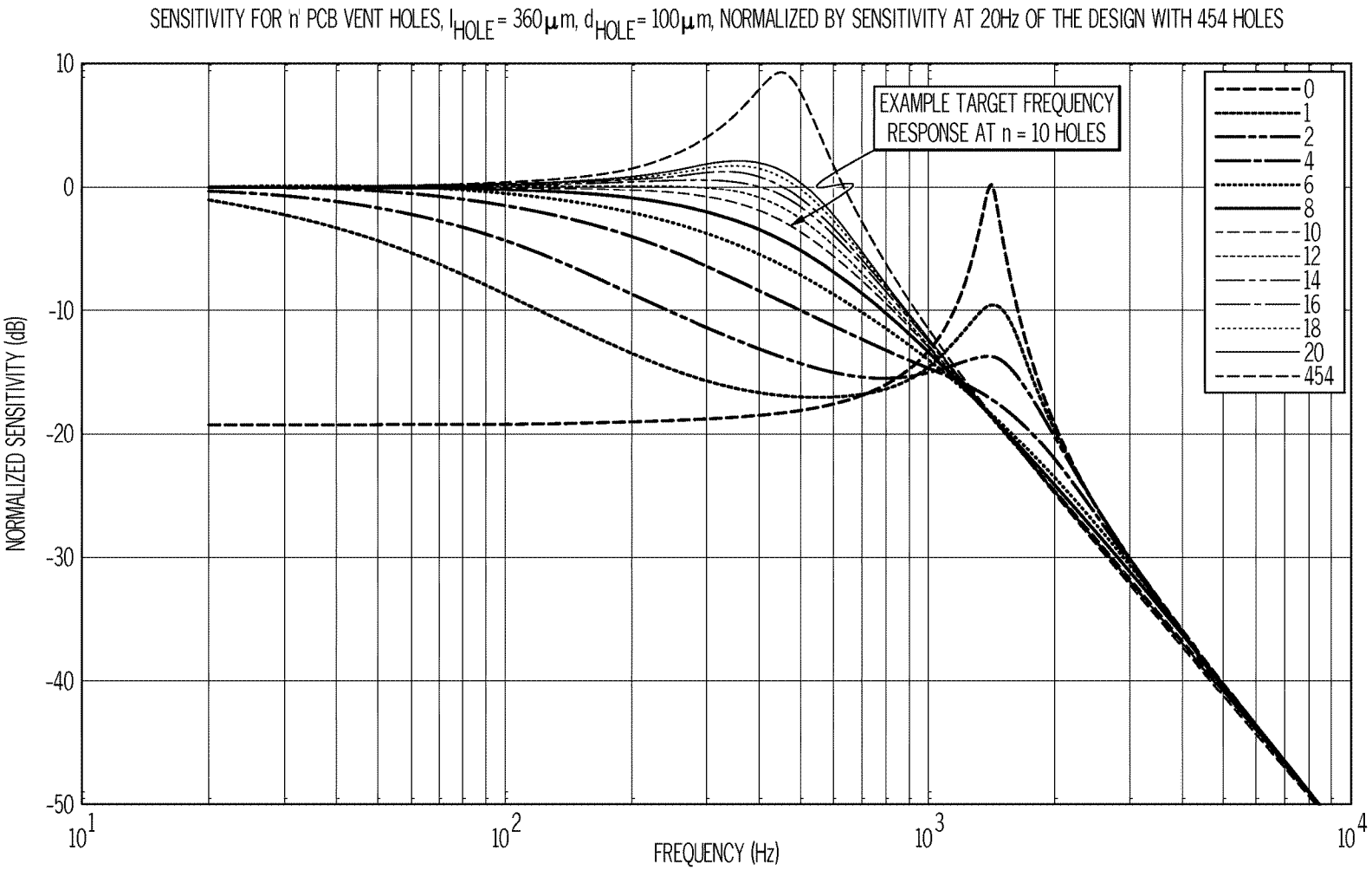

The size, shape, location, number, and placement of the micro vents 225 in the PCB 222 can vary, as can the number of micro vents 225, depending on the desired frequency response for the microspeaker, the mechanical resistance of the microspeaker in a vacuum, manufacturability, and other design considerations. The acoustical resistance provided to the system by each vent hole depends on its length and diameter—in particular, the smaller the diameter, the higher the acoustical resistance (assuming a fixed length), and the longer the hole, the higher the acoustical resistance (assuming a fixed diameter). Additionally, for substantially identical holes, the total acoustical resistance is inversely proportional to the number of holes. Thus, adding holes reduces the total acoustical resistance, while removing holes increases the total acoustical resistance. As an example, for a fixed PCB thickness (and thus vent hole length) of 360 μm, the effect of the acoustical resistance provided by a varying number of holes is shown in FIGS. 12A and 12B, for holes of diameter 50 μm and 100 μm, respectively. In the example of FIGS. 12A and 12B, the PCB through which the holes extend has a thickness of about 360 μm. The number of holes in each case range from zero to the maximum number of holes that can fit on a PCB of a given dimension and minimum hole-to-hole spacing. In each case, the approximate number of holes required for a desired frequency response is noted. It can be seen that more vent holes will be required to achieve the desired frequency response when a smaller diameter vent hole is used. FIG. 11 emphasizes this by depicting the relationship between the approximate number of vent holes required to achieve an example target frequency response for this configuration and the diameter of the vent holes, ranging from 50 μm and 200 μm. The decoupling of the back plate venting and the PCB venting described above allows for greater flexibility in the choice of PCB hole size and number and thus greater control over the frequency response.

When tuning the damping of the microspeaker, a number of micro vents 225 can be determined. By increasing or decreasing the number of micro vents 225 the frequency response can be changed. The micro vents 225 are offset with respect to a set of back plate vents 132, and separated from the back plate vents 132 by the cavity 127, achieving similar benefits as those described with reference to acoustical resistance assembly 100 described in FIGS. 5A and 5B.

Figure 7:
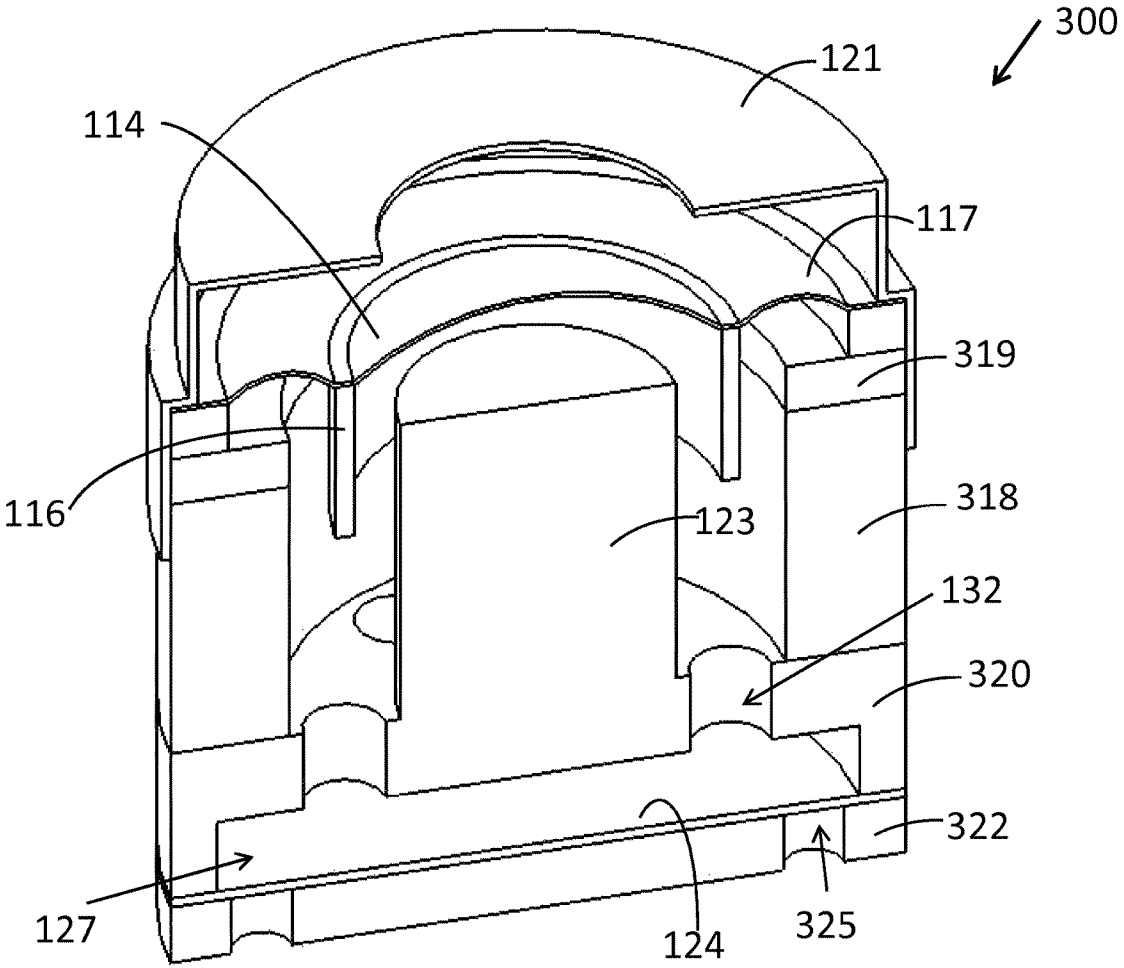
FIG. 7 is an isometric view of a cross-section of a microspeaker with an acoustical resistance assembly, in accordance with some examples.

With reference to FIG. 7, the acoustical resistance assembly 300 includes a protective cover 121, a diaphragm 114, a voice coil 116, a suspension element 117, a front plate 319, a back plate 320, and a printed circuit board (PCB) 322, similar to or the same as those of other embodiments herein. The assembly 300 also includes a magnet 318, which can be similar to or the same as the magnet 18 of FIGS. 1 and 2. In some examples, the magnet 18 is a ring magnet. In other examples, the magnet is a cylindrical magnet. Other magnet types can equally apply. The back plate 322 has a pole piece 123 that extends from a base portion of the back plate 320 towards the diaphragm 114. The voice coil 116 and magnet 318 are each positioned about the pole piece 23.

A cavity 127 is formed by the back plate 320 and a scrim 124 coupled to the PCB 322. The cavity 127 provides for a volume of air can be represented by an equivalent acoustical compliance $C_{AG}$ illustrated in the acoustical impedance circuit 140 illustrated at FIG. 9. Therefore, the acoustical resistance assembly 300 of FIG. 7 can be represented by the acoustical impedance circuit 140 illustrated at FIG. 9. The presence of the cavity 127 and PCB air holes 325 in FIG. 7 permits the acoustical resistance to be tuned without modifying the back plate 320.

Figure 8:
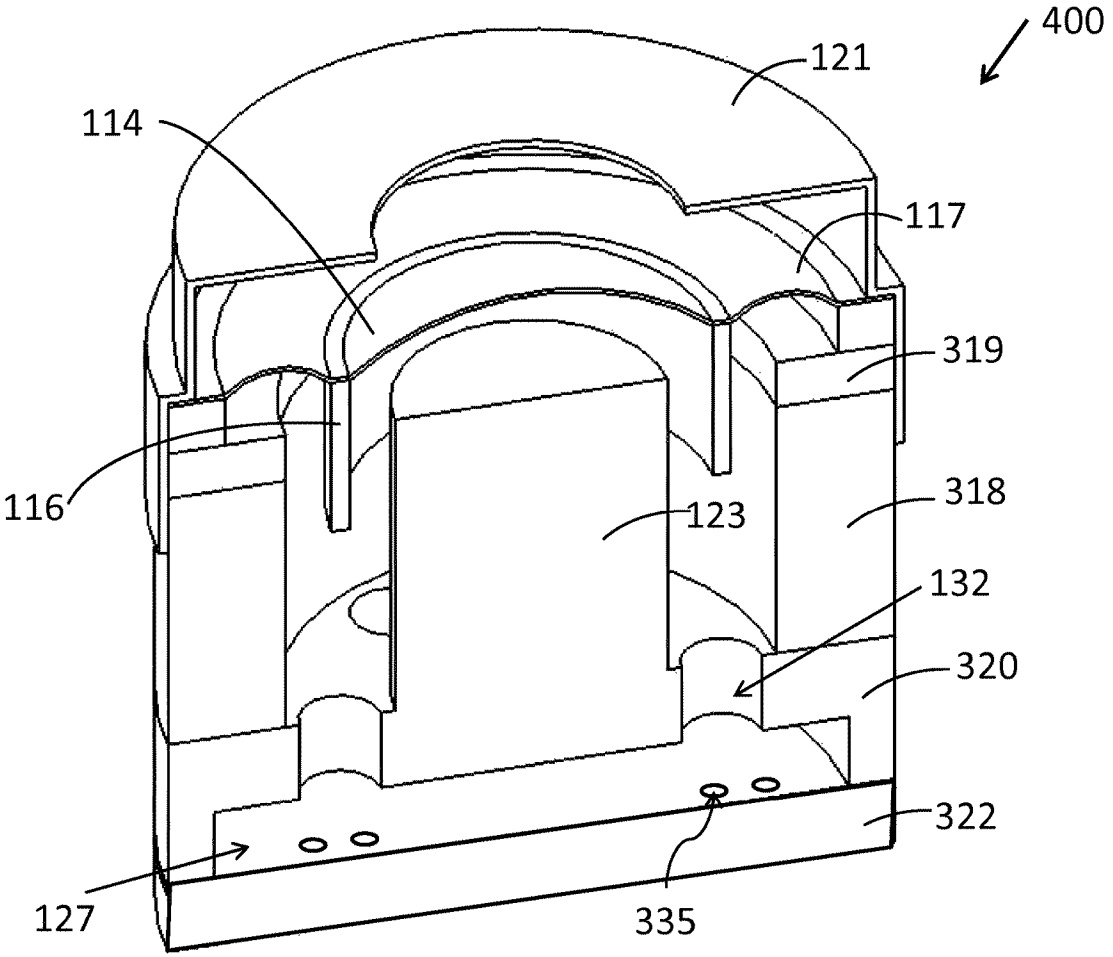
FIG. 8 is an isometric view of a cross-section of a microspeaker with an acoustical resistance assembly, in accordance with some examples.

With reference to FIG. 8, the acoustical resistance assembly 400 is similar to the assembly 300 of FIG. 7, except for presence of micro vents 335 or small apertures extending through the PCB 322 to the cavity 127. The micro vents 335 serve as an "integral vent," obviating the need for a scrim or the like positioned over a PCB opening to achieve a desired acoustical resistance, similar to the example illustrated in FIGS. 6A and 6B.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. An electro-acoustic transducer, comprising:

a diaphragm;

a magnet assembly comprising a magnet and a back plate having a central region at which the magnet is coupled, the back plate further having a peripheral region about an outermost periphery of a bottom region of the magnet, the back plate further comprising a plurality of first vents extending through the peripheral region of the back plate and positioned about the outermost periphery of the bottom region of the magnet, the diaphragm generating sound during a movement of the diaphragm relative to the back plate;

a printed circuit board comprising at least one second vent at or near a periphery of the printed circuit board; and a cavity between the printed circuit board and the back plate that separates the plurality of first vents from the at least one second vent.

2. The electro-acoustic transducer of claim 1, wherein a first geometry of the at least one second vent relative to the plurality of first vents provides a first frequency response for the transducer, and wherein a second geometry of the at least one second vent relative to the plurality of first vents provides a second frequency response different from the first frequency response for the transducer.

3. The electro-acoustic transducer of claim 1, wherein the plurality of first vents includes a hole that is offset from and proximal to an outer diameter of the back plate.

4. The electro-acoustic transducer of claim 1, wherein the plurality of first vents are located at an outer diameter of the back plate and the at least one second vent is located at an outer diameter of the printed circuit board.

5. The electro-acoustic transducer of claim 1, wherein the at least one second vent comprises a plurality of micro apertures extending through the printed circuit board.

6. The electro-acoustic transducer of claim 5, wherein the micro apertures ranges in diameter from 50 μm to 200 μm.

7. The electro-acoustic transducer of claim 1, wherein the at least one second vent comprises a plurality of air holes extending through the printed circuit board and a scrim material coupled to the printed circuit board and positioned over the air holes.

8. The electro-acoustic transducer of claim 1, wherein the plurality of first vents and the at least one second vent are constructed and arranged to provide an acoustical resistance of air flowing between an external environment and an interior of the transducer, and for shaping a frequency response for the electro-acoustic transducer.

9. The electro-acoustic transducer of claim 1, wherein the plurality of first vents of the back plate and the at least one second vent of the printed circuit board each has a total acoustical impedance that includes a real part and an imaginary part, and wherein the real part of the total acoustical impedance of the plurality of first vents is lower than the real part of the total acoustical impedance of the at least one second vent.

10. An electro-acoustic transducer, comprising:

a diaphragm;

a magnet assembly comprising a magnet and a back plate having a central region at which the magnet is coupled, the back plate further having a peripheral region about an outermost periphery of a bottom region of the magnet, the back plate further comprising a plurality of vent holes extending through the peripheral region of the back plate and positioned about the outermost periphery of the bottom region of the magnet, the diaphragm generating sound during a movement of the diaphragm relative to the back plate;

a printed circuit board comprising at least one air hole at or near a periphery of the printed circuit board;

a cavity between the printed circuit board and the back plate that separates the plurality of vent holes from the at least one air hole in the printed circuit board; and a scrim material coupled to a surface of the printed circuit board in the cavity, and positioned over the at least one air hole.

11. The electro-acoustic transducer of claim 10, wherein a first geometry of the plurality of vent holes provides a first frequency response for the transducer, and wherein a second geometry of the plurality of vent holes provides a second frequency response different from the first frequency response for the transducer.

12. The electro-acoustic transducer of claim 10, wherein the plurality of vent holes are offset from an outer diameter of the back plate.

13. The electro-acoustic transducer of claim 10, wherein the plurality of vent holes are located at an outer diameter of the back plate and the at least one are hole is located at an outer diameter of the printed circuit board.

14. The electro-acoustic transducer of claim 10, wherein the plurality of vent holes and the at least one air hole are constructed and arranged to provide an acoustical resistance of air flowing between an external environment and an interior of the transducer, and for shaping a frequency response for the electro-acoustic transducer.

15. The electro-acoustic transducer of claim 10, wherein the plurality of vent holes of the back plate and the at least one air hole of the printed circuit board each has a total acoustical impedance that includes a real part and an imaginary part, and wherein the real part of the total acoustical impedance of the vent holes is lower than the real part of the total acoustical impedance of the at least one printed circuit board vent hole.

16. An acoustic device, comprising:

a diaphragm;

a magnet assembly comprising a magnet and a back plate having a central region at which the magnet is coupled, the back plate further having a peripheral region about an outermost periphery of a bottom region of the magnet, the back plate further comprising a plurality of vent holes extending through the peripheral region of the back plate and positioned about the outermost periphery of the bottom region of the magnet, the diaphragm generating sound during a movement of the diaphragm relative to the back plate;

a printed circuit board comprising at least one micro vent ranging in diameter from 50 μm to 200 μm at or near a periphery of the printed circuit board; and a cavity between the printed circuit board and the back plate that separates the plurality of vent holes from the at least one micro vent of the printed circuit board.

17. The acoustic device of claim 16, wherein a first geometry of the at least one micro vent relative to the plurality of vent holes provides a first frequency response for the transducer, and wherein a second geometry of the at least one micro vent relative to the plurality of vent holes provides a second frequency response different from the first frequency response for the transducer.

18. The acoustic device of claim 16, wherein the plurality of vent holes are offset from an outer diameter of the back plate.

19. The acoustic device of claim 18, wherein the plurality of vent holes are located at an outer diameter of the back plate and the at least one micro vent is located at an outer diameter of the printed circuit board.

20. The acoustic device of claim 16, wherein the plurality of vent holes and the at least one micro vent each has a total acoustical impedance that includes a real part and an imaginary part, and wherein the real part of the total acoustical impedance of the vent holes is lower than a real part of a total acoustical impedance of the at least one micro vent.

* * * * *